US010689733B2

(12) United States Patent
Walker et al.

(10) Patent No.: US 10,689,733 B2
(45) Date of Patent: Jun. 23, 2020

(54) METHODS TO INCREASE SOLID SOLUTION ZIRCONIUM IN ALUMINUM ALLOYS

(71) Applicant: GM GLOBAL TECHNOLOGY OPERATIONS LLC, Detroit, MI (US)

(72) Inventors: Michael J. Walker, Shelby Township, MI (US); Qigui Wang, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 155 days.

(21) Appl. No.: 15/896,615

(22) Filed: Feb. 14, 2018

(65) Prior Publication Data

US 2018/0291480 A1 Oct. 11, 2018

Related U.S. Application Data

(63) Continuation-in-part of application No. 15/481,666, filed on Apr. 7, 2017, now Pat. No. 10,358,695.

(51) Int. Cl.
*C22C 1/02* (2006.01)
*C22C 21/00* (2006.01)
(Continued)

(52) U.S. Cl.
CPC ..... *C22C 1/026* (2013.01); *C22C 1/03* (2013.01); *C22C 9/00* (2013.01); *C22C 21/00* (2013.01);
(Continued)

(58) Field of Classification Search
CPC ..... C22C 1/026; C22C 1/03; C22C 21/00; C22C 45/08; C22C 45/001; C22C 45/00
See application file for complete search history.

(56) References Cited

U.S. PATENT DOCUMENTS 3,190,750 A 6/1965 Staggers et al.
3,307,857 A 3/1967 Conant
(Continued)

FOREIGN PATENT DOCUMENTS

CN 103111609 A 5/2013
CN 108690918 A 10/2018
(Continued)

OTHER PUBLICATIONS

CN 103111609 A human translation (Year: 2013).*
(Continued)

*Primary Examiner* — Tima M. McGuthry-Banks
(74) *Attorney, Agent, or Firm* — Harness, Dickey & Pierce, P.L.C.

(57) ABSTRACT

A method of making an aluminum alloy containing zirconium includes heating a first composition including aluminum to a first temperature. The first temperature is greater than or equal to a liquidus temperature of the first composition. The method further includes adding a second composition including a copper-zirconium compound to the first composition. The method further includes decomposing at least a portion of the copper-zirconium compound into copper and zirconium. The method further includes forming a third composition by dissolving at least some of the copper from the decomposing in the aluminum of the first composition. The method further includes cooling the third composition to a second temperature to form a first solid material. The second temperature is less than or equal to a solidus temperature of the third composition. The method further includes heat treating the first solid material to form the aluminum alloy containing zirconium.

19 Claims, 4 Drawing Sheets

(51) Int. Cl.

| | |
|---|---|
| ***C22C 1/03*** | (2006.01) |
| ***C22F 1/04*** | (2006.01) |
| ***C22C 9/00*** | (2006.01) |
| ***C22C 45/00*** | (2006.01) |
| ***C22C 45/08*** | (2006.01) |

(52) U.S. Cl.
CPC ..... *C22C 45/00* (2013.01); *C22C 45/001* (2013.01); *C22C 45/08* (2013.01); *C22F 1/04* (2013.01)

(56) References Cited

U.S. PATENT DOCUMENTS

| | | | |
|---|---|---|---|
| 3,462,248 | A | 8/1969 | Roberts et al. |
| 3,694,195 | A | 9/1972 | Yokota |
| 3,933,476 | A | 1/1976 | Chopra et al. |
| 4,063,936 | A | 12/1977 | Nagase et al. |
| 5,135,582 | A | 8/1992 | Mochizuki et al. |
| 6,123,899 | A | 9/2000 | Setzer et al. |
| 6,202,618 | B1 | 3/2001 | Baxter et al. |
| 6,543,405 | B2 | 4/2003 | Sachdev et al. |
| 6,945,214 | B2 | 9/2005 | Sachdev et al. |
| 7,938,058 | B2 | 5/2011 | Becker et al. |
| 9,339,990 | B2 | 5/2016 | Jang et al. |
| 9,533,351 | B2 | 1/2017 | Bishop et al. |
| 2012/0087826 | A1 | 4/2012 | Senkov et al. |
| 2018/0010215 | A1 | 1/2018 | Sanaty-Zedah et al. |
| 2018/0291479 | A1 | 10/2018 | Walker et al. |
| 2019/0345588 | A1 | 11/2019 | Walker et al. |

FOREIGN PATENT DOCUMENTS

| | | | |
|---|---|---|---|
| CN | 110468307 | A | 11/2019 |
| DE | 102018107859 | A1 | 10/2018 |
| DE | 102019110793 | A1 | 11/2019 |

OTHER PUBLICATIONS

Shaha, S.K. et al.; "Improving High-Temperature Tensile and Low-Cycle Fatigure Behavior of Al—Si—Cu—Mg Alloys Through Micro-additions of Ti, V, and Zr;" Metallurgical Transactions A; vol. 46, No. 5; Apr. 10, 2015; 16 pages.

"Copper-zirconium (CuZr) Master Alloy—Properties and Applications," KBM Affilips; http://azom.com/article.aspx?ArticleID=10863; Apr. 3, 2014; 4 pages.

Guo, Zhanying et al., "Effects of two-step homogenization on precipitation behavior of $Al_3Zr$ dispersoids and recrystallization resistance in 7150 aluminum alloy," *Materials Characterization*, 102 (2015), pp. 122-130.

Ito, Seitaro et al., "A synthesis of crystalline $Li_7P_3S_{11}$ solid electrolyte from 1,2-dimethoxyethane solvent," *Journal of Power Sources*, 271, (2014) 342-345.

Shi, Cangji et al., "Effect of Zr addition on hot deformation behavior and miscrostructural evolution of AA7150 aluminum alloy," *Material Science & Engineering A*, 506 (2014) pp. 183-193.

Walker, Michael J. et al., U.S. Appl. No. 15/975,159, filed May 9, 2018 entitled "Methods to Increase Titanium in Aluminum Alloys," 63 pages.

Campbell, F.C. (ed) "Phase Diagrams—Understanding the Basics," Ch. 6: Peritectic Alloy Systems, ASM International (2012), pp. 117-134.

Khan, Atta U. et al "Crystal Structure of novel compounds in the systems Zr—Cu—Al, Mo—Pd—Al and partial phase equilibria in the Mo—Pd—Al system." Dalton Transactions. vol. 41. pp. 2296-2303. doi: 10.1039/cldt11972a (Year: 2012).

Shao, G. "Thermodynamic and kinetic aspects of intermetallic amorphous alloys." Intermetallics. vol. 11, pp. 313-324. doi: 10.1015/S0966-9795(02)00248-0 (Year: 2003).

Tretyachenko, Ludmila, "Aluminum-Copper-Zirconium." Ternary Alloy Systems. G. Effenberg (ED). Subvolume A, Part 2. pp. 206-222. doi.org/10.1007/10915967_14 (Year: 2005).

Wang, C.P. et al. "Experimental investigation of phase equilibria in the Zr—Cu—Al system." Intermetallics. vol. 31 pp. 1-8. doi: 10.1016/j.intermet.2012.04.014 (Year: 2012).

Zhou, Chenyang et al. "Thermodynamic assessment of the phase equilibria and prediction of glass-forming ability of the Al—Cu—Zr system." Journal of Non-Crystalline Solids 461. pp. 47-60. Available online Feb. 3, 2017. doi:org/10.1016/j.noncrysol.2016.09.031 (Year: 2017).

First Office Action in Chinese Patent Application No. 201810257934.1 dated Sep. 27, 2019 with English language machine translation, 13 pages.

J. Paul Lyle et al., "Aluminum Alloys," Ulmann's Encyclopedia of Industrial Chemistry (2002); DOI: 10.1002/14356007.a01_481.

* cited by examiner

METHODS TO INCREASE SOLID SOLUTION ZIRCONIUM IN ALUMINUM ALLOYS

CROSS-REFERENCE TO RELATED APPLICATIONS

This application is a continuation-in-part of U.S. patent application Ser. No. 15/481,666 filed on Apr. 7, 2017. The entire disclosure of the above application is incorporated herein by reference.

GOVERNMENT SUPPORT

This application is a continuation-in-part of U.S. patent application Ser. No. 15/481,666 filed on Apr. 7, 2017 which issued as U.S. Pat. No. 10,358,965. The entire disclosure of the above application is incorporated herein by reference.

INTRODUCTION

This section provides background information related to the present disclosure which is not necessarily prior art.

The present disclosure pertains to methods for increasing zirconium in aluminum alloys by the introduction and dissolution of copper-zirconium compounds, alloys, and powders.

As background, components formed using aluminum alloys have become ever more prevalent in various industries and applications, including general manufacturing, construction equipment, automotive or other transportation industries, home or industrial structures, aerospace, and the like. For example, aluminum alloys are commonly used in manufacturing industries for castings, such as, for example, engine heads, engine blocks, transmission cases, and suspension components in the automobile industry. It is often desirable to increase thermal stability of aluminum alloys for elevated temperature applications by increasing solid state zirconium levels to improve microstructure and avoid degradation of mechanical properties of the alloy. However, zirconium generally has low solubility in various aluminum alloys, thus posing challenges with enhancing an amount of solid state zirconium in aluminum alloys.

SUMMARY

This section provides a general summary of the disclosure, and is not a comprehensive disclosure of its full scope or all of its features.

The present disclosure provides in certain aspects, a method of making an aluminum alloy containing zirconium. The method includes heating a first composition including aluminum to a first temperature. The first temperature is greater than or equal to a liquidus temperature of the first composition. The method further includes adding a second composition including a copper-zirconium compound to the first composition. The method further includes decomposing at least a portion of the copper-zirconium compound into copper and zirconium. The method further includes forming a third composition by dissolving at least some of the copper from the decomposing in the aluminum of the first composition. The method further includes cooling the third composition to a second temperature to form a first solid material. The second temperature is less than or equal to a solidus temperature of the third composition. The method further includes heat treating the first solid material to form the aluminum alloy containing zirconium.

In one aspect, forming the third composition further includes dissolving at least some of the zirconium from the decomposing in the aluminum.

In one aspect, the heat treating the first solid material facilitates formation of a first plurality of precipitates as a distinct phase in the aluminum alloy containing zirconium.

In one aspect, the precipitates of the first plurality of precipitates have an average dimension of less than or equal to about 500 microns (μm).

In one aspect, the precipitates of the first plurality of precipitates have an average dimension of less than or equal to about 500 nanometers (nm).

In one aspect, the first plurality of precipitates includes at least one of $Zr_3Al$, $Al_3SiZr$, $(AlSi)_3(TiVZr)$, $(AlSi)_3(TiZr)$, $(AlSi)_2(VZr)$.

In one aspect, the heat treating the first solid material includes heating the first solid material to a third temperature to form a second solid material. The third temperature is less than a solidus of the first solid material. The heat treating the first solid material further includes cooling the second solid material to a fourth temperature to form a third solid material. The fourth temperature is less than the third temperature. The heat treating the first solid material further includes heating the third solid material to a fifth temperature to form the first plurality of precipitates and form the aluminum alloy containing zirconium. The fifth temperature is greater than the fourth temperature.

In one aspect, the heating the first solid material to the third temperature causes at least some of the zirconium from the decomposing to dissolve in the aluminum, a solid solution zirconium content of the second solid material being less than or equal to about 0.2% by mass of the aluminum.

In one aspect, the first temperature is greater than about 580° C. to less than or equal to about 800° C. The second temperature is less than or equal to about 660° C. The cooling the third composition includes solidifying the third composition at a cooling rate of greater than or equal to about 0.1° C./second to less than or equal to about 100° C./second. The fourth temperature is greater than or equal to about 20° C. to less than or equal to about 300° C. The fifth temperature is greater than or equal to about 100° C. and less than or equal to about 350° C.

In one aspect, the aluminum alloy containing zirconium further includes a second plurality of precipitates including aluminum and zirconium.

In one aspect, the second plurality of precipitates includes at least one of $Zr_3Al$, $Al_3SiZr$, $(AlSi)_3(TiVZr)$, $(AlSi)_3(TiZr)$, $(AlSi)_2(VZr)$.

In one aspect, the aluminum alloy containing zirconium further includes a third plurality of precipitates including the copper-zirconium compound.

In one aspect, the aluminum alloy containing zirconium includes zirconium at greater than or equal to about 0.05% by mass to less than or equal to about 15% by mass.

In one aspect, the aluminum alloy containing zirconium includes copper at greater than or equal to about 0.05% by mass to less than or equal to about 10% by mass.

In one aspect, the copper-zirconium compound has the formula $Cu_xZr_y$ and includes: $Cu_9Zr_2$, $Cu_{51}Zr_{14}$, $Cu_8Zr_3$, $Cu_{10}Zr_7$, $CuZr$, $CuZr_2$, $Cu_aZr_b$ where a/b is less than or equal to 0.5, or combinations thereof.

In one aspect, the aluminum alloy containing zirconium includes an average grain size of greater than or equal to about 10 microns (μm) to less than or equal to about 10 centimeters (cm).

In one aspect, the aluminum alloy containing zirconium includes a casting aluminum alloy selected from the group consisting of: 2xx series, 3xx series, 4xx series, 5xx series, 7xx series, and combinations thereof.

In one aspect, the aluminum alloy containing zirconium includes a wrought aluminum alloy selected from the group consisting of: 2xxx series, 3xxx series, 4xxx series, 5xxx series, 6xxx series, 8xxx series, and combinations thereof.

The present disclosure provides in various aspects a method of making an aluminum alloy containing zirconium. The method includes heating a first composition including aluminum to a first temperature of greater than or equal to a liquidus temperature of the first composition. The method further includes adding a second composition includes a copper-zirconium compound to the first composition. The method further includes decomposing at least a portion of the copper-zirconium compound. The method further includes forming a third composition by dissolving at least a portion of the copper from the decomposing in the aluminum of the first composition. The method further includes cooling the third composition to a second temperature less than or equal to a solidus temperature of the third composition to form a first solid material. The method further includes heating the first solid material to a third temperature of greater than the second temperature to form a second solid material. The method further includes cooling the second solid material to a fourth temperature less than the third temperature to form a third solid material. The method further includes heating the third solid material to a fifth temperature greater than the fourth temperature to form the aluminum alloy containing zirconium.

The present disclosure provides in various aspects an aluminum alloy containing zirconium. The aluminum alloy containing zirconium includes a precipitate phase, aluminum, copper, and zirconium. The precipitate phase includes compounds of zirconium and aluminum and having a dimension of less than or equal to about 500 nanometers (nm). The copper is included greater than or equal to about 0.05% by mass and less than or equal to about 10% by mass. The zirconium is included at greater than or equal to about 0.05% by mass and less than or equal to about 15% by mass.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
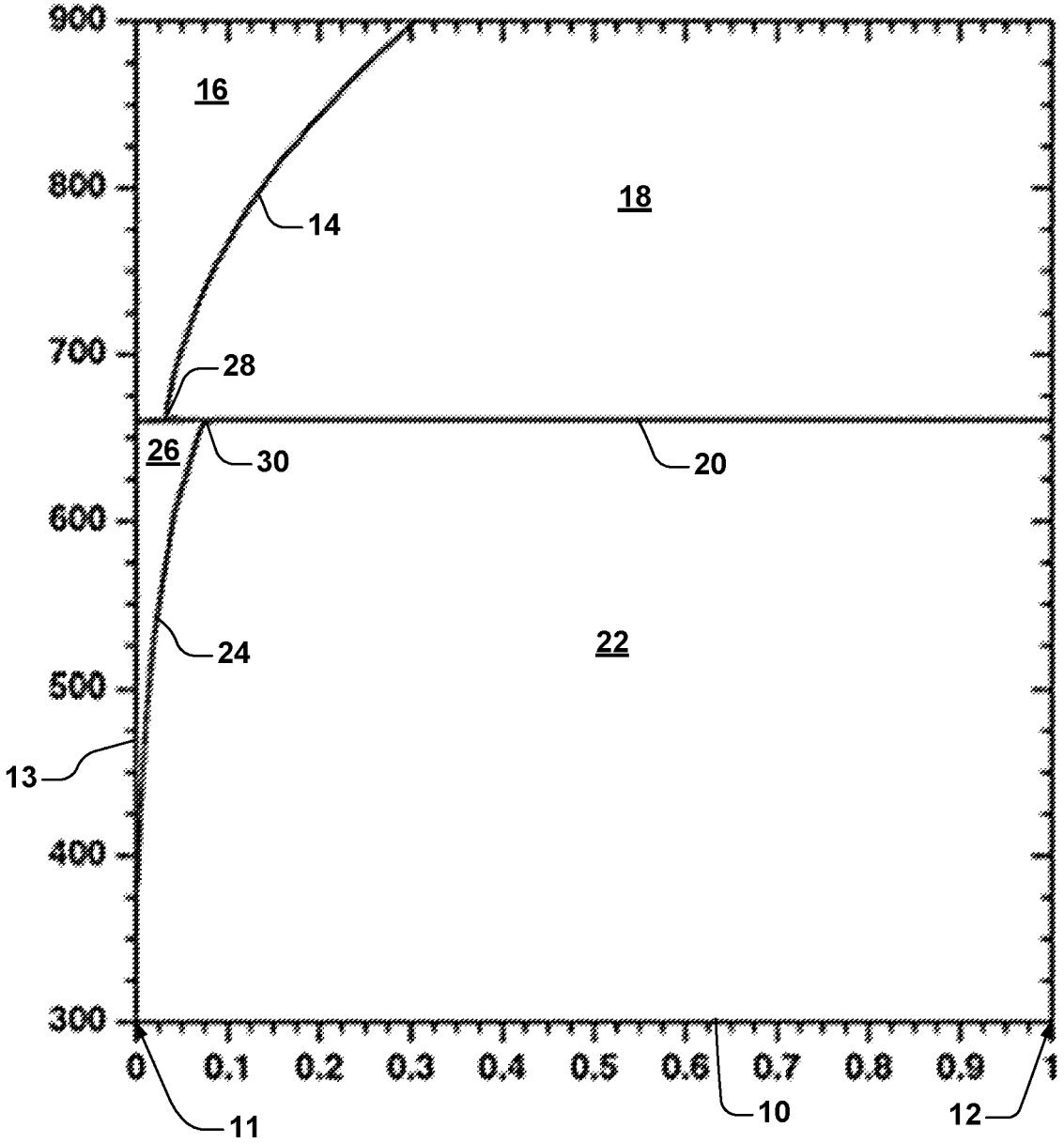
FIG. 1 is a partial phase diagram of a binary aluminum-zirconium system showing a peritectic transition at about 660.8° C.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of" Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

Example embodiments will now be described more fully with reference to the accompanying drawings.

Aluminum alloys are widely used in vehicles, such as automobiles, motorcycles, boats, tractors, buses, mobile homes, campers, and tanks. The use of aluminum alloys will continue with efforts to reduce vehicle mass and save space. Methods of processing aluminum alloys according to the present technology form components with reduced mass relative to components made with traditional alloys, such as steel, while maintaining strength and ductility requirements. Aluminum alloys are particularly suitable for use in components of an automobile or other vehicles (e.g., motorcycles, boats), but may also be used in a variety of other industries and applications, including aerospace components, industrial equipment and machinery, farm equipment, and heavy machinery, by way of non-limiting example.

Aluminum and its alloys are lightweight and are therefore desirable for use in fuel-efficient vehicles. One factor that may limit automotive applications of aluminum and its alloys is its thermal stability. At temperatures above about 200° C., certain material phases that maintain alloy strength can coarsen or dissolve, resulting in decreased performance. The use of zirconium in an aluminum alloy has the potential to improve the microstructure and mechanical properties of the alloy. Thus, there is a need for methods of making zirconium-containing aluminum alloys and methods of increasing the amount of zirconium in aluminum alloys.

In various aspects, the present disclosure provides a method of making an aluminum alloy that includes at least aluminum, zirconium, and copper. In certain variations, the present disclosure provides a method of increasing the amount of zirconium in aluminum alloys. More specifically, certain methods according to the present disclosure add zirconium to an aluminum alloy melt by introducing a master alloy including a copper-zirconium compound (e.g., $Cu_xZr_y$). Copper is soluble in aluminum, and solubility of copper in aluminum drives the decomposition of the copper-zirconium master alloy. The decomposition of the copper-zirconium master alloy releases both copper and zirconium, thereby making zirconium available to dissolve in the aluminum alloy melt and/or form precipitates with aluminum and other components of the aluminum alloy melt (e.g., $ZrAl_3$, $Al_3SiZr$, $(AlSi)_3(TiVZr)$, $(AlSi)_3(TiZr)$, $(AlSi)_2(VZr)$). In various methods, the use of a master alloy including a copper-zirconium compound in aluminum increases solid solution zirconium content in the aluminum alloy because the aluminum-zirconium system is peritectic and therefore it has a higher solubility for zirconium in the solid state than in the liquid state.

Referring to FIG. 1, a partial binary aluminum-zirconium phase diagram is shown. The x-axis 10 represents atomic percent zirconium, where 0% zirconium is shown at 11 and 1% zirconium is shown at 12. The y-axis 13 represents temperature in ° C. A liquidus 14 represents a phase boundary between a liquid phase 16 and a liquid+solid phase 18. In this aluminum-zirconium system, the liquid phase 16 includes aluminum with zirconium dissolved therein. The liquid+solid phase 18 includes both liquid, which is aluminum with zirconium dissolved therein, and $ZrAl_3$. A solidus 20 represents a phase boundary between the liquid+solid phase 18 and a first solid phase 22. The first solid phase 22 includes solid aluminum having zirconium dissolved therein, and $ZrAl_3$. A solvus 24 represents a phase boundary between the first solid phase 22 and a second solid phase 26 that is substantially homogeneous. The second solid phase 26 includes aluminum with zirconium dissolved therein.

The aluminum-zirconium system is peritectic. In a peritectic system, two phases, one of them being liquid, transform into a new solid phase upon cooling. Here, the liquid phase 16 and the liquid+solid phase 18 (i.e., liquid+$ZrAl_3$) can be cooled to form the second solid phase 26 (i.e., (Al)). Another feature of the peritectic system is that the zirconium solute has a higher solubility in the solid-phase aluminum than in the liquid-phase aluminum. At the peritectic temperature of about 680.8° C., the liquid solubility 28 of zirconium in aluminum is about 0.033 atomic percent (i.e., 0.08% by mass) and the solid solubility 30 is about 0.083 atomic percent (i.e., 0.2% by mass). Thus, at the peritectic temperature (i.e., 680.8° C.), the solid solubility 30 of zirconium in aluminum is greater than the liquid solubility 28 of zirconium in aluminum.

Creating aluminum alloys having zirconium may present certain challenges. In particular, zirconium can be difficult to dissolve in aluminum. In one example, waffle plates formed from a master alloy including aluminum and $ZrAl_3$ at about 25% zirconium by mass (the "master alloy including aluminum and zirconium") may be added to an aluminum melt to create an aluminum alloy containing zirconium. Creating the aluminum alloy containing zirconium in this manner can be challenging because of the high density and high melting temperature of $ZrAl_3$, as described in greater detail below.

$ZrAl_3$ has a relatively high density and stability compared to a relatively low density of the aluminum melt. For example, at a temperature of about 600° C., the density of $ZrAl_3$ is greater than or equal to about 1.6 to less than or equal to 1.8 times that of the aluminum melt. The relatively high density of $ZrAl_3$ can cause it to sink to the bottom of the aluminum melt, even with constant stirring. The settling of $ZrAl_3$ at the bottom of the aluminum melt is problematic because the aluminum melt may quickly reach its zirconium solubility limit in a bottom region of bath of the furnace where the $ZrAl_3$ is located. Meanwhile, a top region of the bath of the furnace away from the $ZrAl_3$ may include little to no dissolved $ZrAl_3$. Thus, the overall composition of the aluminum melt may include zirconium in an amount far less than the liquid solubility limit.

Another challenge in using the master alloy including aluminum and zirconium to introduce and dissolve zirconium in aluminum is that $ZrAl_3$ has a high melting temperature compared to the temperature of the aluminum melt. The melting temperature of $ZrAl_3$ is about 1580° C. The $ZrAl_3$ melting temperature is much higher compared to aluminum alloy melts, which may be in a range of greater than or equal to about 580° C. to less than or equal to about 800° C., depending on the specific composition of the aluminum alloy melt. Thus, the high temperatures required to melt $ZrAl_3$ can present an additional challenge in dissolving zirconium in aluminum by way of the master alloy including aluminum and zirconium.

To compensate for the above challenges, zirconium may be added to a melt in great excess. However, even when the zirconium is added to the melt in excess, the final alloy composition may be limited by zirconium's solubility in aluminum alloy melt. More particularly, the final alloy composition may be limited by zirconium's liquid solubility in aluminum. In various aspects, the present disclosure provides an aluminum alloy containing zirconium and methods of making the aluminum alloy containing zirconium. In certain variations, the aluminum-containing zirconium alloys of the present disclosure may include increased zirconium content compared to other zirconium-containing aluminum alloys formed from the techniques described above or other similar techniques.

The methods according to certain aspects of the present disclosure can produce aluminum alloys having advantageous high temperature properties. Specifically, the methods may significantly increase the amount of zirconium available to form precipitate structures, decrease precipitate size, and increase precipitate density. The fine, dense precipitates formed in certain methods of the present disclosure may improve material properties of the aluminum alloy containing zirconium by inhibiting recrystallization, in both cast and wrought alloys, and pinning grain and subgrain boundaries. Furthermore, the zirconium may inhibit the growth of undesirable precipitate structures such as a θ (theta) phase, an S phase, a Q phase, a β (beta) phase, and other phases that may be present depending on the alloy composition.

Figure 2:
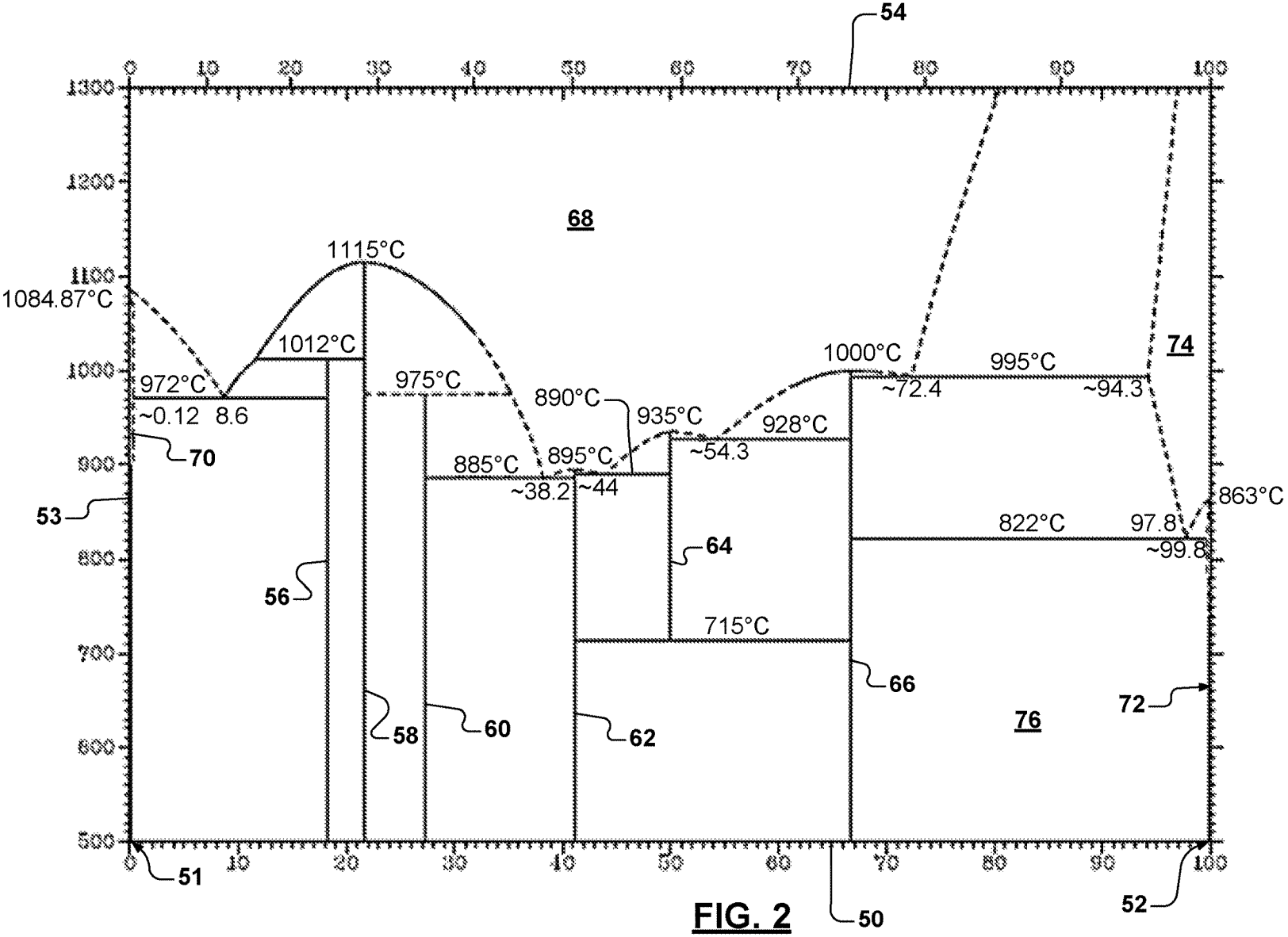
FIG. 2 is a partial phase diagram of a binary copper-zirconium system.

Referring now to FIG. 2, an exemplary partial binary phase diagram is shown that is believed to be representative of a binary copper-zirconium system. A first x-axis 50 represents atomic percent of zirconium in copper, where 0% zirconium is shown at 51 and 100% zirconium is shown at 52. A second x-axis 53 represents mass percent of zirconium in copper. A y-axis 54 represents temperature in ° C. A first phase boundary 56 corresponds to a $Cu_9Zr_2$ intermetallic. A second phase boundary 58 corresponds to a $Cu_{51}Zr_{14}$ intermetallic. A third phase boundary 60 corresponds to a $Cu_8Zr_3$ intermetallic. A fourth phase boundary 62 corresponds to a $Cu_{10}Zr_7$ intermetallic. A fifth phase boundary 64 corresponds to a CuZr intermetallic. A sixth phase boundary 66 corresponds to a $CuZr_2$ intermetallic. A first region 68 represents a liquid phase. A second region 70 represents a substantially homogeneous solid copper phase having zirconium dissolved therein (i.e., (Cu)). A third region 72 represents a substantially homogeneous solid α-zirconium phase having copper dissolved therein (i.e., (αZr)). A fourth region 74 represents a homogeneous solid β-zirconium phase having zirconium dissolved therein (i.e., (βZr)). Additional copper-zirconium compounds not shown on the partial phase diagram for the binary copper-zirconium system may exist. In various aspects, the additional copper-zirconium compounds may be non-equilibrium copper-zirconium compounds having the formula $Cu_aZr_b$, where a/b is less than or equal to 0.5. The non-equilibrium copper-zirconium compounds may exist in a fifth region 76. Without being bound to any theory, it is believed that the non-equilibrium copper-zirconium compounds may be formed as a result of the non-binary system.

In a binary copper-zirconium system, the $Cu_9Zr_2$, $Cu_{51}Zr_{14}$, $Cu_8Zr_3$, $Cu_{10}Zr_7$, and $CuZr_2$ (represented by the first, second, third, fourth, and sixth phase boundaries 56, 58, 60, 62, 66, respectively) remain stable as their temperature is lowered to at least 500° C. The CuZr, represented by the fifth phase boundary 64, remains stable as its temperature is lowered to about 715° C. When the temperature is lowered below 715° C., the CuZr becomes unstable and decomposes into $Cu_{10}Zr_7$ (i.e., the fourth phase boundary 62) and $CuZr_2$ (i.e., the sixth phase boundary 66). However, as will be discussed in greater detail below, copper-zirconium compounds may surprisingly and unexpectedly behave differently in a non-binary system, such as when the copper-zirconium compound is added to melt including aluminum. More particularly, although certain copper-zirconium compounds were believed to be stable down to at least 500° C. (e.g., $Cu_9Zr_2$, $Cu_{51}Ar_{14}$, $Cu_8Zr_3$, $Cu_{10}Zr_7$, and $CuZr_2$), they may unexpectedly become unstable and decompose when introduced into a non-binary system (e.g., a system including aluminum).

Figure 3:
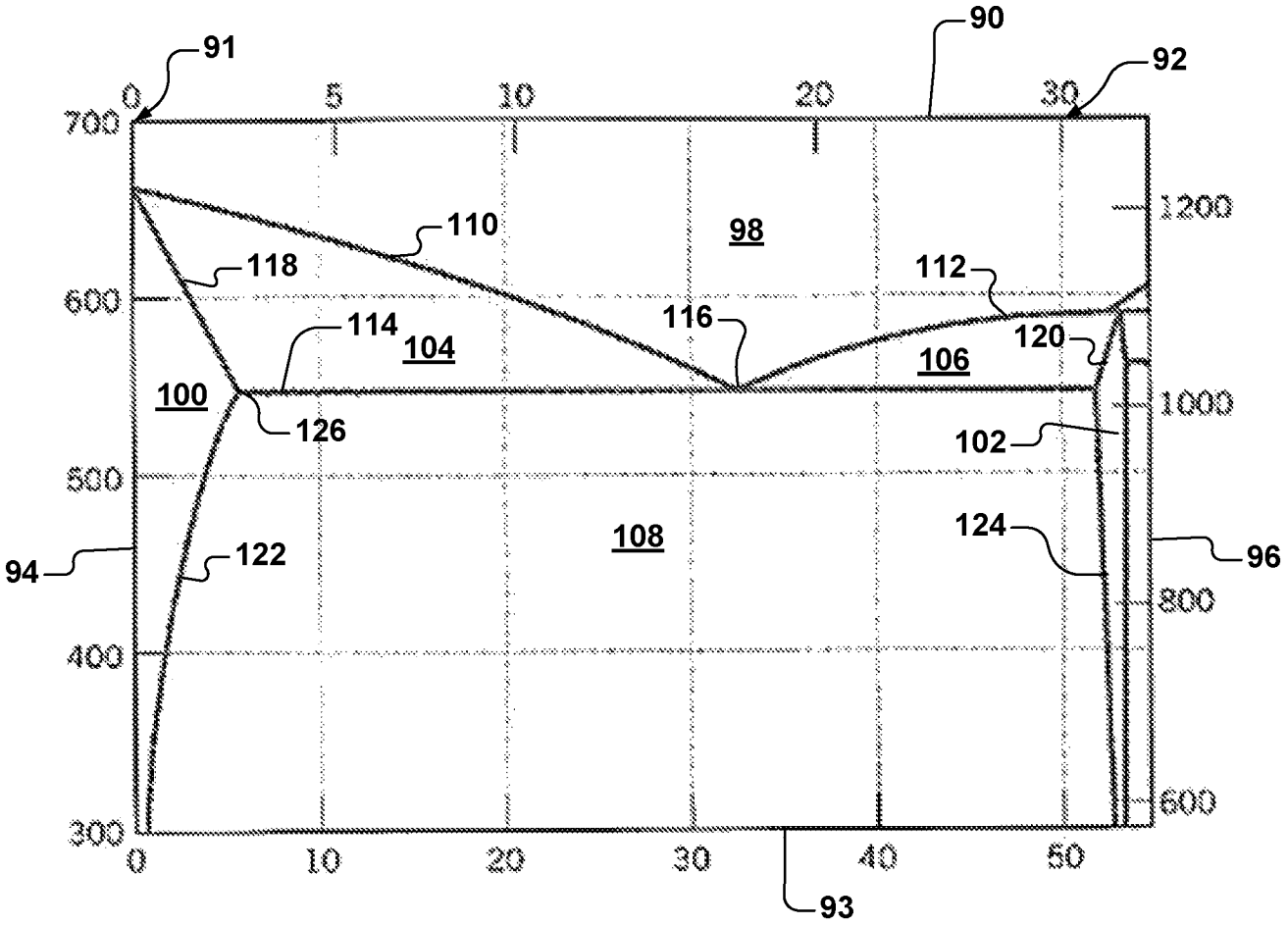
FIG. 3 is a partial phase diagram of a binary aluminum-copper system.

With reference to FIG. 3, an exemplary partial binary phase diagram is shown that is believed to be representative of a binary aluminum-copper system. A first x-axis 90 represents atomic percent of copper in aluminum, where 0% copper is shown at 91 and 30% copper is shown at 92. A second x-axis 93 represents mass percent of copper in aluminum. A first y-axis 94 represents temperature in ° C. A second y-axis 96 represents temperature in ° F. A first region 98 represents a liquid phase. A second region 100 represents an α phase (i.e., (Al)). A third region 102 represents a θ phase (i.e., ($CuAl_2$)). A fourth region 104 represents an α+liquid phase. A fifth region 106 represents a θ+liquid phase. A sixth region 108 represents a solid α+θ phase.

A first phase boundary or first liquidus 110 separates the first region 98 and the fourth region 104. A second phase boundary or second liquidus 112 separates the first region 98 and the fifth region 106. A third phase boundary or solidus 114 separates the sixth region 108 from the fourth, first, and fifth regions 104, 98, 106. The first and second phase boundaries 110, 112 (i.e., first and second liquiduses) meet the solidus 114 at a eutectic point 116. A fourth phase boundary 118 separates the second region 100 and the fourth region 104. A fifth phase boundary 120 separates the fifth region 106 and the third region 102. A sixth phase boundary 122 separates the second region 100 and the sixth region 108. A seventh phase boundary 124 separates the third region 102 and the sixth region 108.

A maximum solubility of copper in aluminum 126 occurs where the fourth and sixth phase boundaries 118, 122 meet the third phase boundary 114 (i.e., the solidus). The maximum solubility of copper in aluminum 126 is about 6% by weight. Therefore, when copper is introduced into a pure aluminum melt, the copper will dissolve in the aluminum up to about 6% by weight.

When copper is introduced into an aluminum melt as a copper-zirconium compound, the copper-zirconium compound may decompose to make copper available for dissolving in the aluminum. The amount of copper-zirconium that can dissolve is dependent upon the solubility of copper in the aluminum melt. The copper-zirconium compound decomposes until the maximum solubility of copper in the aluminum melt is reached.

The zirconium of the copper-zirconium compound is also released during decomposition, making it available for dissolving in the aluminum melt and/or forming precipitates. The amount of zirconium available as a result of the decomposition depends on the specific copper-zirconium compound used. More particularly, the amount of zirconium available depends on the molar ratio of copper and zirconium in the copper-zirconium compound. As one non-limiting example, when the copper-zirconium compound is $CuZr_2$, two moles of zirconium are released for every one mole of copper released. In another non-limiting example, when the copper-zirconium compound is $Cu_{51}Zr_{14}$, fourteen moles of zirconium are released for every fifty-one moles of copper released. Thus, the amount of zirconium available to be dissolved in the aluminum and/or to form precipitates with aluminum depends on both (1) the molar ratio of copper to zirconium in the copper-zirconium compound, and (2) the amount of the copper-zirconium compound that decomposes. The amount of copper-zirconium compound that decomposes depends on both (1) the amount of aluminum in the aluminum melt and (2) the solubility of copper in the aluminum melt (e.g., about 6% by weight in a binary aluminum-copper system).

A method according to certain aspects of the present disclosure relies on the tendency of copper-zirconium compounds to decompose in the presence of aluminum to make zirconium available for dissolving in aluminum and/or forming precipitates with aluminum, thereby forming an aluminum alloy containing zirconium. In certain variations, the aluminum alloy containing zirconium includes an aluminum casting alloy selected from the group consisting of: 2xx series aluminum alloys (e.g., two hundred series aluminum alloys), 3xx series aluminum alloys (e.g., three hundred series aluminum alloys), 4xx series aluminum alloys (e.g., four hundred series aluminum alloys), 5xx series aluminum alloys (e.g., five hundred series aluminum alloys), 7xx series aluminum alloys (e.g., seven hundred series aluminum alloys), and combinations thereof. In certain other variations, the aluminum alloy containing zirconium melt includes a wrought aluminum alloy selected from the group consisting of: 2xxx series aluminum alloys (e.g., two thousand series aluminum alloys), 3xxx series aluminum alloys (e.g., three thousand series aluminum alloys), 4xxx series aluminum alloys (e.g., four thousand series aluminum alloys), 5xxx series aluminum alloys (e.g., five thousand series aluminum alloys), 6xxx series aluminum alloys (e.g., six thousand series aluminum alloys), 8xxx series aluminum alloys (e.g., eight thousand series aluminum alloys), and combinations thereof.

Figure 4:
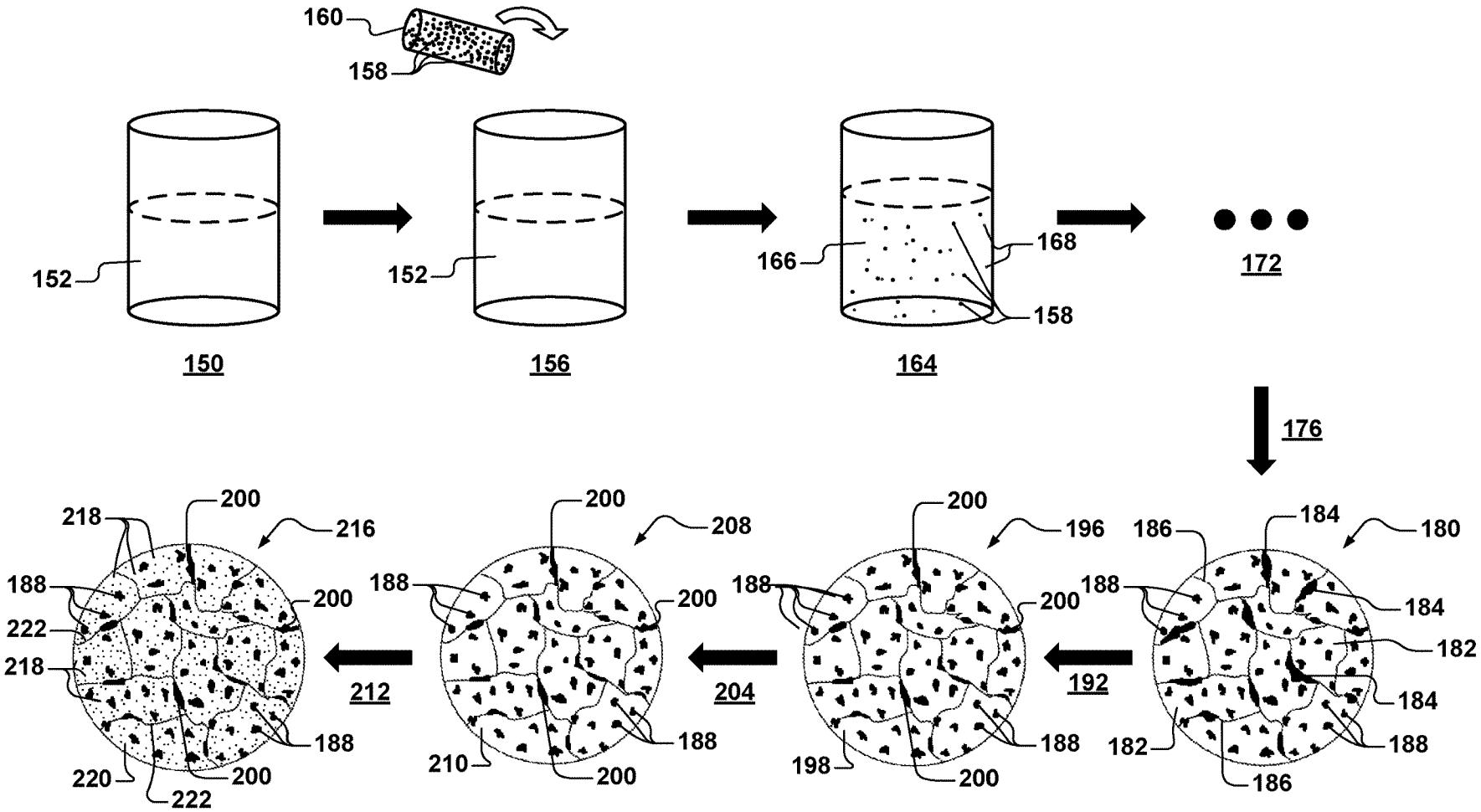
FIG. 4 is a schematic of a method of making an aluminum alloy containing zirconium according to certain aspects of the present disclosure.

Referring now to FIG. 4, at 150, an aluminum melt 152 having a first composition is brought to a first temperature or pouring temperature of greater than or equal to a liquidus temperature (i.e., melting temperature) of the first composition. In certain variations, the first temperature may be greater than or equal to about 580° C. to less than or equal to about 800° C., optionally greater than or equal to about 650° C. to less than or equal to about 780° C. The first composition may be an aluminum alloy that includes other components in addition to aluminum, such as copper, manganese, silicon, magnesium, zinc, and combinations thereof, by way of non-limiting example.

At 156, a master alloy that includes a copper-zirconium compound 158 may be added to the aluminum melt 152. The copper-zirconium compound 158 may be in the form of a powder. The powderized copper-zirconium compound 158 may be encased in aluminum 160. Encasing the copper-zirconium compound 158 in aluminum may facilitate better mixing by reducing challenges related to surface tension that would be present without the aluminum. In various alternative embodiments, copper-zirconium compound 158 may be added to the aluminum melt 152 by way of a powder injection using an inert gas. The copper-zirconium compound 158 may have a second composition. In certain aspects, the second composition may include less than or equal to about 90% zirconium by mole, optionally greater than or equal to about 18% zirconium by mole and less than or equal to about 90% zirconium by mole, and optionally greater than or equal to about 18% zirconium by mole and less than or equal to about 67% zirconium by mole. The second composition may include copper-zirconium intermetallics and/or non-equilibrium compounds of copper and zirconium, such as metallic glasses and/or amorphous metal. In various aspects, the copper-zirconium compound 158 may be represented by the formula $Cu_xZr_y$. Suitable copper-zirconium intermetallics may include $Cu_9Zr_2$, $Cu_{51}Zr_{14}$, $Cu_8Zr_3$, $Cu_{10}Zr_7$, CuZr, $CuZr_2$, and combinations thereof (as represented by the first, second, third, fourth, fifth, and sixth phase boundaries 56, 58, 60, 62, 64, 66 of FIG. 2), by way of non-limiting example. Suitable non-equilibrium compounds of copper and zirconium may be represented by the formula $Cu_aZr_b$, where a/b is less than or equal to 0.5, by way of non-limiting example (e.g., compounds in the fifth region 76 of FIG. 2). The copper-zirconium compound 158 may include other elements in addition to copper and zirconium.

The copper-zirconium compound 158 may begin decomposing in the presence of aluminum. The copper-zirconium compound 158 may continue to decompose as long as the aluminum melt 152 has solubility for copper. As the copper-zirconium compound 158 decomposes, zirconium is released from the copper-zirconium compound 158. Some of the zirconium may also dissolve in the aluminum melt 152. The zirconium released as a result of the decomposition of the copper-zirconium compound 158 may form compounds with aluminum and/or other elements in the aluminum melt 152.

At 164, a third composition 166 includes the aluminum alloy having copper and zirconium dissolved therein. The third composition 166 may include dissolved copper in an amount less than or equal to the liquid solubility of copper in the aluminum alloy (e.g., the maximum solubility 126 of copper in aluminum is about 6% by weight in the binary aluminum-copper system of FIG. 3) and dissolved zirconium in an amount less than or equal to the liquid solubility of zirconium in the aluminum alloy (e.g., the liquid solubility 28 of zirconium in aluminum is about 0.033 atomic percent in the binary aluminum-zirconium system FIG. 1). A portion of the copper-zirconium compound 158 that does not decompose may be present. Moreover, the undissolved zirconium resulting from the decomposition may form a plurality of particles including aluminum and zirconium compounds 168 that may also be present. The copper-zirconium compound 158 and the plurality of particles 168 may be in solid phase. At 172, the third composition 166 having the copper-zirconium compound 158 and the particles 168 dispersed therein may be cast or otherwise formed.

At 176, the third composition 166 with the copper-zirconium compound 158 and the particles 168 dispersed therein may be cooled or solidified. The solidification may include cooling the third composition 166 with the copper-zirconium compound 158 and the particles 168 dispersed therein to a second temperature below a solidus of the third composition to form a first solid material 180. In certain embodiments, the solidification may occur at a cooling rate of greater than or equal to about 0.01° C./second to less than or equal to about 100° C./second, optionally greater than or equal to about 0.01° C. to less than or equal to about 50° C./second, optionally greater than or equal to about 0.01° C./second to less than or equal to about 20° C., and optionally about 10° C./second. The second temperature may be below the solidus, which varies based on the third composition 166. In certain variations, the second temperature may be less than or equal to about 660° C., optionally less than or equal to about 420° C., and in certain variations, optionally less than or equal to about 200° C. so that the third composition 166 is quenched.

As the third composition 166 is cooled during solidification, the solubility of zirconium in aluminum may change, certain copper-zirconium compounds 158 may further decompose (e.g., CuZr, as represented by the fifth phase boundary 64 of FIG. 2), and precipitates of aluminum and zirconium may form. The amount of dissolved zirconium may change as the solubility of zirconium in the aluminum alloy changes with temperature (see, e.g., FIG. 1). If CuZr is present in the copper-zirconium compound 158, it may decompose when the temperature is lowered to 715° C. or less. Excess zirconium that cannot be dissolved in the aluminum alloy (i.e., zirconium above the solid solubility limit in the aluminum alloy) may form precipitates with aluminum and other components of the aluminum alloy (e.g., $ZrAl_3$, $Al_3SiZr$, $(AlSi)_3(TiVZr)$, $(AlSi)_3(TiZr)$, $(AlSi)_2(VZr)$).

In some variations, large precipitates form during solidification and cooling. For example, the first solid material 180 may include aluminum grains 182 having precipitates of aluminum and zirconium 184 ("the first plurality of aluminum-zirconium precipitates") dispersed near grain boundaries 186. The first plurality of aluminum-zirconium precipitates 184 may include precipitates of only aluminum and zirconium (e.g., $Zr_3Al$) and/or precipitates of aluminum, zirconium, and other elements of the aluminum alloy (e.g., $Al_3SiZr$, $(AlSi)_3(TiVZr)$, $(AlSi)_3(TiZr)$, $(AlSi)_2(VZr)$). The precipitates of the first plurality of aluminum-zirconium precipitates 184 may be relatively large, having an average dimension of greater than or equal to about 5 μm to less than or equal to about 500 μm. In various aspects, larger precipitates may be less desirable than smaller precipitates because larger are easily avoidable by dislocations and therefore result in alloys having decreased material properties. In certain other variations, no precipitates are formed during the cooling step. The formation and characteristics of precipitates are highly dependent on rate of cooling, second temperature, and the composition. The remaining copper-zirconium compound 158 that did not dissolve may be present in the first solid material 180 as a plurality of non-soluble precipitates 188.

The first solid material 180 may undergo heat treatment beginning at 192 to facilitate the formation of desirable precipitates to change the microstructure of the first solid material 180. The heat treatment may include three steps: (1) solutionizing (i.e., 192), (2) quenching (i.e., 204), and (3) aging (i.e., 212). Generally, a material is heated in the solutionizing step to dissolve a solute and form a solid solution. The solid solution is quenched by rapidly lowering its temperature to form a quenched solution that is oversaturated. The quenched solid solution is aged to form fine precipitates that enhance the material properties of the alloy.

At 192, solutionizing involves raising the temperature of the first solid material 180 to a third temperature and holding the first solid material 180 at the third temperature to form a second solid material 196. The third temperature may be greater than the second temperature. In certain aspects, the third temperature may be greater than or equal to a solvus of the system. Higher temperatures generally promote desirable faster diffusion. The third temperature may be less than or equal to the solidus. However, the third temperature may be as close to the solidus as possible without exceeding the solidus, thereby maximizing the solubility of zirconium in the aluminum alloy (see, e.g., solid solubility 30 for the binary aluminum-zirconium system of FIG. 1). In contrast, due to the peritectic reaction, if the third temperature exceeds the solidus temperature and liquid begins to form, the solubility of zirconium decreases. In certain aspects, the aspects, the third temperature may be greater than or equal to the solvus of the system to less than or equal to the solidus of the system.

In certain aspects, during solutionizing, zirconium resulting from the decomposition of the copper-zirconium compound is available to be dissolved in the solid solution aluminum alloy. The amount of the zirconium dissolved in the aluminum of the first material may be less than or equal to the solid peritectic composition (e.g., 0.2% by mass in a binary aluminum-zirconium system). By way of non-limiting example, the solid peritectic composition of zirconium in aluminum may be less than or equal to about 0.2% by mass. The second solid material 196 may include aluminum grains 198. The aluminum grains 198 may include the aluminum alloy having zirconium (up to the solid solubility) and copper dissolved therein. The second solid material 196 may also include the plurality of non-soluble precipitates 188 and a second plurality of aluminum-zirconium precipitates 200 (e.g., $Zr_3Al$, $Al_3SiZr$). The non-soluble precipitates 188 may remain unchanged during solutionizing. In certain aspects, the precipitates of the second plurality of aluminum-zirconium precipitates 200 may generally be smaller than precipitates of the first plurality of aluminum-zirconium precipitates 184 of the first solid material 180 because more of the zirconium is dissolved in the aluminum alloy and unavailable to form the precipitates 200.

At 204, the second solid material 196 may be quenched, for example by water or forced air, to form a third solid material 208. During quenching, the second solid material 196 may be brought to a fourth temperature. For example, second solid material 196 may be quenched at a rate of greater than or equal to about 10° C./second to less than or equal to about 100° C./second. The fourth temperature may be less than the third temperature. In certain embodiments, the fourth temperature may be greater than or equal to about 20° C. to less than or equal to about 300° C., and optionally greater than or equal to about 20° C. to less than or equal to about 160° C., by way of non-limiting example. During quenching, the dissolved zirconium is "locked" in solution because it does not have enough time to diffuse or migrate out. More specifically, because of the rapid cooling rate, the zirconium atoms do not have sufficient time to diffuse to nucleation sites and precipitates do not form as readily as when lower cooling rates are used. Thus, the third solid material 208 includes an aluminum matrix 210 that is over-saturated with zirconium and is therefore unstable. The non-soluble precipitates 188 and the aluminum-zirconium precipitates 200 may remain unchanged after quenching.

The third solid material 208 may be aged at 212 to form a fourth solid material or an aluminum alloy containing zirconium 216. The aging process may facilitate the formation of desirable fine precipitates 218 dispersed throughout an aluminum matrix 220. The aging may be artificial or natural (i.e., performed at room temperature over a longer period of time than artificial aging). During artificial aging, the third solid material 208 may be brought to a fifth temperature that is higher than the fourth temperature. By way of non-limiting example, the fifth temperature may be greater than or equal to about 100° C. to less than or equal to about 350° C., optionally greater than or equal to about 160° C. to less than or equal to about 350° C., and optionally about 200° C. Because the solid solution aluminum of the aluminum matrix 210 of the third solid material 208 is unstable, aging can cause zirconium to come out of solid solution and form the precipitates 218. These precipitates 218 may be complex compounds with other elements contained in the alloy (e.g., $Zr_3Al$, $Al_3SiZr$, $(AlSi)_3(TiVZr)$, $(AlSi)_3(TiZr)$, $(AlSi)_2(VZr)$). The fifth temperature is low enough that diffusion of the zirconium is relatively short and the fine precipitates 218 grow within the aluminum matrix 220 as opposed to forming at grain boundaries 222. The non-soluble precipitates 188 and the aluminum-zirconium precipitates 200 remain substantially unchanged during aging. In various aspects, the fine precipitates 218 may be referred to as a first plurality of precipitates, the second plurality of aluminum-zirconium precipitates 200 may be referred to as a second plurality of precipitates, and the non-soluble precipitates 188 may be referred to as a third plurality of precipitates.

The heat treatment may be a T6 or T7 aluminum alloy heat treatment that includes solutionizing, quenching, and aging, as described above. However, in alternative variations, the material may be quenched and then aged without a solutionizing step (i.e., a T5 heat treatment). In other alternative variations, for wrought alloys, the solid material may go directly into a rolling process after casting at 176 that takes place at greater than or equal to about 300° C. to less than or equal to about 350° C. In still other alternative variations, the wrought material may go through a cold rolling process at around 100° C. In some variations, wrought alloys may be heat treated after rolling.

Returning to FIG. 4, the aluminum alloy containing zirconium includes at least aluminum, zirconium, and copper. In certain variations, zirconium may be present in the aluminum at a higher composition than the solid solubility of zirconium in the aluminum alloy. For example, the aluminum alloy containing zirconium 216 may include up to about 15% zirconium by mass of the aluminum alloy containing zirconium 216. In certain variations, the aluminum alloy containing zirconium 216 may have greater than 0% zirconium by mass to less than or equal to about 15% zirconium by mass, optionally greater than or equal to about 0.05% zirconium by mass to less than or equal to about 15% zirconium by mass, optionally greater than or equal to about 0.08% zirconium by mass to less than or equal to about 5% zirconium by mass, optionally greater than or equal to about 0.08% zirconium by mass to less than or equal to about 2% zirconium by mass, optionally greater than or equal to about 0.08% zirconium by mass to less than or equal to about 1% zirconium by mass, optionally greater than or equal to about 0.08% zirconium by mass to less than or equal to about 0.5% zirconium by mass, and optionally greater than or equal to about 0.08% zirconium by mass zirconium to less than or equal to about 0.2% zirconium by mass.

The presence of precipitates allows for zirconium concentrations that are higher than the solid solubility of zirconium in the aluminum alloy. For example, as described above, zirconium may be present in the aluminum alloy containing zirconium 216 at up to 15% zirconium by mass of the aluminum alloy containing zirconium 216. Zirconium may be present in the aluminum alloy containing zirconium 216 both in solid solution and in various precipitates. More particularly, zirconium may be present: (1) in solid solution in the aluminum matrix 220, (2) as fine precipitates 218, (3) as aluminum-zirconium precipitates 200, and (4) as non-soluble precipitates 188. Greater than 0% and less than or equal to about 15% zirconium by mass of the aluminum alloy containing zirconium 216 may cumulatively be present in (1) solid solution in the aluminum matrix 220, (2) the fine precipitates 218, (3) the aluminum-zirconium precipitates 200, and (4) the non-soluble precipitates 188. In certain variations, the zirconium in (1) solid solution in the aluminum matrix 220 and (2) fine precipitates 218 may be limited by the solid solubility of zirconium in the system (e.g., the peritectic solid solubility of zirconium in the aluminum alloy, such as 0.2% by mass in the binary aluminum-zirconium system of FIG. 1). Thus, greater than 0% and less than or equal to about 0.2% zirconium by mass of the aluminum alloy containing zirconium 216 may cumulatively be present in (1) the aluminum matrix 220 and (2) the fine precipitates 218. The balance of zirconium may be present in (3) the aluminum-zirconium precipitates 200 and (4) the non-soluble precipitates 188.

In certain variations, the aluminum alloy containing zirconium 216 includes copper at greater than or equal to 0.05% by mass to less than or equal to about 10% by mass, optionally greater than or equal to about 0.1% by mass to less than or equal to about 8% by mass, optionally greater than or equal to about 0.1% by mass to less than or equal to about 6% by mass, optionally greater than or equal to about 0.1% by mass to less than or equal to about 5% by mass optionally greater than or equal to about 0.1% by mass to less than or equal to about 4% by mass, optionally greater than or equal to about 0.1% by mass to less than or equal to about 0.5% by mass, and optionally greater than or equal to about 0.1% by mass to less than or equal to about 0.4% by mass. The aluminum alloy containing zirconium 216 may include copper and zirconium in the above ranges and the balance aluminum and other components of the aluminum alloy (e.g., manganese, silicon, magnesium, zinc). The aluminum alloy containing zirconium 216 may include aluminum at less than or equal to about 99%, optionally less than or equal to about 98%, optionally less than or equal to about 97%, optionally less than or equal to about 96%, optionally less than or equal to about 95%, optionally less than or equal to about 90%, optionally less than or equal to about 75%, optionally less than or equal to about 70%, and optionally less than or equal to about 65% by mass of the alloy.

The fine precipitates 218 formed during aging may have a dimension of less than or equal to about 500 μm, optionally less than or equal to about 1 μm, optionally less than or equal to about 500 nm, and optionally less than or equal to about 200 nm. The distribution of the fine precipitates 218 throughout the aluminum matrix 220 may strengthen the aluminum alloy containing zirconium 216 by restricting dislocation or resisting the growth of other precipitate phases such as a θ (theta) phase, a Q phase, or a β (beta) phase, by way of non-limiting example. That is, the fine precipitates 218 may pin the grains of the aluminum matrix 220 so that they do not slip past one another during stress. The fine precipitates 218 may also be advantageous in grain refinement and prevention of grain growth, particularly in wrought alloys. Aluminum alloys containing zirconium 216 according to certain aspects of the present disclosure have grains with an average dimension of less than or equal to about 10 cm, optionally less than or equal to about 1 cm, optionally less than or equal to about 1 mm, optionally less than or equal to about 500 μm, optionally less than or equal to about 200 μm, optionally less than or equal to about 100 μm, and optionally less than or equal to about 10 μm.

Alloys formed by methods according to certain aspects of the present disclosure may be applicable to various casting processes for a variety of vehicle or automotive components. For example, aluminum alloys containing zirconium may be used for cylinder heads and blocks. Alloys formed by the methods according to certain aspects of the present disclosure may also be used for wrought products, such as extrusion billets, extruded rods, tubes, sheets, and forged materials, by way of non-limiting example.

While exemplary components are described above, it is understood that the inventive concepts in the present disclosure may also be applied to any structural component capable of being formed of a lightweight metal, including those used in vehicles, like automotive applications including, but not limited to, pillars, such as hinge pillars, panels, including structural panels, door panels, and door components, interior floors, floor pans, roofs, exterior surfaces, underbody shields, wheels, storage areas, including glove boxes, console boxes, trunks, trunk floors, truck beds, lamp pockets and other components, shock towers, shock tower cap, control arms and other suspension or drive train components, engine mount brackets, transmission mount brackets, alternator brackets, air conditioner compressor brackets, cowl plates, and the like. The aluminum alloys containing zirconium according to the present disclosure may likewise be used in non-automotive applications, such as buildings, windows, aircrafts, pumps, and other mechanical components, by way of non-limiting example.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of making an aluminum alloy comprising zirconium, the method comprising:

heating a first composition comprising aluminum to a first temperature of greater than or equal to a liquidus temperature of the first composition;

adding a second composition comprising a copper-zirconium compound to the first composition, the copper-zirconium compound is selected from the group consisting of: $Cu_9Zr_2$, $Cu_{51}Zr_{14}$, $Cu_8Zr_3$, $Cu_{10}Zr_7$, $CuZr_2$, or a combination thereof;

forming a third composition by decomposing at least a portion of the copper-zirconium compound into copper and zirconium, at least a portion of the copper dissolving in aluminum;

cooling the third composition to a second temperature less than or equal to a solidus temperature of the third composition to form a first solid material;

dissolving at least a portion of the zirconium after the cooling; and heat treating the first solid material to form the aluminum alloy comprising zirconium.

2. The method of claim 1, wherein the heat treating the first solid material facilitates formation of a first plurality of precipitates as a distinct phase in the aluminum alloy comprising zirconium.

3. The method of claim 2, wherein the precipitates of the first plurality of precipitates have an average dimension of less than or equal to about 500 microns (μm).

4. The method of claim 3, wherein the precipitates of the first plurality of precipitates have an average dimension of less than or equal to about 500 nanometers (nm).

5. The method of claim 2, wherein the first plurality of precipitates comprises at least one of $Zr_3Al$, $Al_3SiZr$, $(AlSi)_3(TiVZr)$, $(AlSi)_3(TiZr)$, and $(AlSi)_2(VZr)$.

6. The method of claim 2, wherein the heat treating the first solid material comprises:

heating the first solid material to a third temperature of less than a solidus of the first solid material to form a second solid material;

cooling the second solid material to a fourth temperature of less than the third temperature to form a third solid material; and heating the third solid material to a fifth temperature greater than the fourth temperature to form the first plurality of precipitates and form the aluminum alloy comprising zirconium.

7. The method of claim 6, wherein the heating the first solid material to the third temperature is performed concurrently with the dissolving at least the portion of the zirconium and a solid solution zirconium content of the second solid material is less than or equal to about 0.2% by mass of the aluminum.

8. The method of claim 2, wherein the aluminum alloy comprising zirconium further comprises a second plurality of precipitates comprising aluminum and zirconium.

9. The method of claim 8, wherein the second plurality of precipitates comprises at least one of $Zr_3Al$, $Al_3SiZr$, $(AlSi)_3(TiVZr)$, $(AlSi)_3(TiZr)$, and $(AlSi)_2(VZr)$.

10. The method of claim 8, wherein the aluminum alloy comprising zirconium further comprises a third plurality of precipitates comprising the copper-zirconium compound.

11. The method of claim 1, wherein the heat treating the first solid material comprises:

heating the first solid material to a third temperature of less than a solidus of the first solid material to form a second solid material;

cooling the second solid material to a fourth temperature of greater than or equal to about 20° C. to less than or equal to about 300° C. to form a third solid material; and heating the third solid material to a fifth temperature greater than or equal to about 100° C. and less than or equal to about 350° C. to form the first plurality of precipitates and form the aluminum alloy comprising zirconium, wherein:

the first temperature is greater than about 580° C. to less than or equal to about 800° C.;

the second temperature is less than or equal to about 660° C.; and the cooling the third composition comprises solidifying the third composition at a cooling rate of greater than or equal to about 0.1° C./second to less than or equal to about 100° C./second.

12. The method of claim 1, wherein the aluminum alloy comprising zirconium comprises zirconium at greater than or equal to about 0.05% by mass to less than or equal to about 15% by mass.

13. The method of claim 12, wherein the aluminum alloy comprising zirconium comprises copper at greater than or equal to about 0.05% by mass to less than or equal to about 10% by mass.

14. The method of claim 1, wherein the copper-zirconium compound has the formula $Cu_xZr_y$, and comprises: $Cu_9Zr_2$, $Cu_{51}Zr_{14}$, $Cu_8Zr_3$, $Cu_{10}Zr_7$, CuZr, $CuZr_2$, $Cu_aZr_b$ where a/b is less than or equal to 0.5, or combinations thereof.

15. The method of claim 1, wherein the aluminum alloy comprising zirconium comprises an average grain size of greater than or equal to about 10 microns (μm) to less than or equal to about 10 centimeters (cm).

16. The method of claim 1, wherein the aluminum alloy comprising zirconium comprises (i) a casting aluminum alloy selected from the group consisting of: 2xx series, 3xx series, 4xx series, 5xx series, 7xx series, and combinations thereof or (ii) a wrought aluminum alloy selected from the group consisting of: 2xxx series, 3xxx series, 4xxx series, 5xxx series, 6xxx series, 8xxx series, and combinations thereof.

17. The method of claim 1, wherein the copper-zirconium compound comprises the $CuZr_2$.

18. A method of making an aluminum alloy comprising zirconium, the method comprising:

heating a first composition comprising aluminum to a first temperature of greater than or equal to a liquidus temperature of the first composition;

adding a second composition comprising a copper-zirconium compound to the first composition;

forming a third composition by decomposing at least a first portion of the copper-zirconium compound into copper and zirconium, at least a portion of the copper dissolving in aluminum;

cooling the third composition to a second temperature less than or equal to a solidus temperature of the third composition to form a first solid material;

after the cooling, decomposing a second portion of the copper-zirconium compound into copper and zirconium and dissolving at least a portion of the zirconium in the aluminum; and heat treating the first solid material to form the aluminum alloy comprising zirconium.

19. The method of claim 18, wherein the copper-zirconium composition has a molar composition of greater than or equal to about 41% zirconium to less than or equal to about 67% zirconium and a balance of copper.

* * * * *